US006560807B1

(12) United States Patent
Stubler et al.

(10) Patent No.: US 6,560,807 B1
(45) Date of Patent: May 13, 2003

(54) CABLE WITH PARALLEL WIRES FOR BUILDING WORK STRUCTURE, ANCHORING FOR SAID CABLE, AND ANCHORING METHOD

(75) Inventors: Jérôme Stubler, Paris (FR); Patrick Ladret, Montbrison (FR); Jean-Claude Percheron, Vienne Arthies (FR)

(73) Assignee: Freyssinet International (STUP) (FR)

( * ) Notice: Subject to any disclaimer, the term of this patent is extended or adjusted under 35 U.S.C. 154(b) by 0 days.

(21) Appl. No.: 09/831,840

(22) PCT Filed: Sep. 12, 2000

(86) PCT No.: PCT/FR00/02509

§ 371 (c)(1),
(2), (4) Date: May 15, 2001

(87) PCT Pub. No.: WO01/20096

PCT Pub. Date: Mar. 22, 2001

(30) Foreign Application Priority Data

Sep. 15, 1999 (FR) ..... 99 11515

(51) Int. Cl.[7] ..... D02G 3/00; E01D 19/16

(52) U.S. Cl. ..... 14/22; 428/373; 428/375; 428/397

(58) Field of Search ..... 14/18, 19, 20, 14/22, 23; 405/259.1; 428/357, 364, 373, 374, 375, 377, 397

(56) References Cited

U.S. PATENT DOCUMENTS

| | | | | | |
|---|---|---|---|---|---|
| 1,537,698 | A | * | 5/1925 | Robinson | 14/22 |
| 1,678,292 | A | * | 7/1928 | Howe | 14/22 |
| 1,921,606 | A | * | 8/1933 | Cremer | 174/103 |
| 2,095,721 | A | * | 10/1937 | Sunderland | 14/22 |
| 3,457,717 | A | * | 7/1969 | Durkee et al. | 57/233 |
| 3,500,625 | A | * | 3/1970 | Gokyu | 57/222 |
| 3,548,432 | A | * | 12/1970 | Durkee et al. | 14/21 |
| 3,659,633 | A | * | 5/1972 | Durkee et al. | 140/111 |
| 3,673,624 | A | * | 7/1972 | Finsterwalder et al. | 14/19 |
| 3,919,762 | A | * | 11/1975 | Borelly | 14/22 |
| 4,117,582 | A | * | 10/1978 | Borelly | 14/22 |
| 4,160,613 | A | * | 7/1979 | Stanwick | 405/244 |
| 4,247,225 | A | * | 1/1981 | Chickini, Jr. et al. | 405/260 |
| 4,473,915 | A | * | 10/1984 | Finsterwalder | 14/18 |
| 4,557,007 | A | | 12/1985 | Daiguji et al. | |
| 4,633,540 | A | | 1/1987 | Jungwirth et al. | |
| 4,648,146 | A | * | 3/1987 | Nutzel et al. | 14/21 |
| 4,693,044 | A | * | 9/1987 | Jartoux | 52/223.14 |
| 4,776,161 | A | * | 10/1988 | Sato et al. | 428/375 |
| 5,197,157 | A | * | 3/1993 | De La Fuente | 14/18 |
| 5,208,077 | A | * | 5/1993 | Proctor et al. | 118/634 |
| 5,390,386 | A | * | 2/1995 | Mathey et al. | 14/22 |
| 5,683,642 | A | | 11/1997 | Muguruma et al. | |
| 5,721,047 | A | * | 2/1998 | Thicthener et al. | 156/166 |
| 6,301,735 | B1 | * | 10/2001 | Jartoux et al. | 14/20 |

FOREIGN PATENT DOCUMENTS

| | | | |
|---|---|---|---|
| DE | 36 44 414 | * | 4/1988 |
| DE | 44 41 772 | * | 6/1996 |
| EP | 0 789 110 | | 8/1997 |
| EP | 0 855 471 | | 7/1998 |
| EP | 1 013 830 | * | 6/2000 |
| FR | 2 794 477 | * | 12/2000 |
| JP | 7-279122 | * | 10/1995 |

* cited by examiner

*Primary Examiner*—Gary S. Hartmann
(74) *Attorney, Agent, or Firm*—Cantor Colburn LLP

(57) ABSTRACT

A reinforcement for a building works structure comprising an assembly of solid wires. The wires are mutually parallel to form a bundle and the reinforcement comprises a sheath made of plastic material enclosing the bundle and providing it with cohesion.

9 Claims, 3 Drawing Sheets

CABLE WITH PARALLEL WIRES FOR BUILDING WORK STRUCTURE, ANCHORING FOR SAID CABLE, AND ANCHORING METHOD

FIELD OF THE INVENTION

The present invention relates to the field of reinforcements used in building work structures.

The invention is aimed in particular, although not exclusively, among these structures, at those intended to equip cable stayed bridges, suspension bridges or the like. The reinforcements habitually encountered in such structures comprise a certain number of wires.

In known embodiments of the reinforcements of the kind in question, the various constituent wires are (generally twisted around a central wire. This arrangement is used to produce a strand, also known as a twist, made from wires of small diameter. The mechanical properties of the strand obtained are better than those of a single-wire strand in which the cross section of the single wire is equivalent to that of said strand.

DESCRIPTION OF THE RELATED ART

Twisting the peripheral wires around a central wire secures the wires of the strand or twist together and reduces the flexural inertia of the assembly. A reinforcement unit is thus obtained from very high-strength wires.

However, producing the twisted strand or twist entails a special twisting operation which is expensive. In addition, this operation gives rise to differential elongation between the central wire and the peripheral wires. The peripheral wires are therefore less highly stressed than the central wire, giving rise to an apparent elastic modulus for the strand which is lower than that of each constituent wire.

Furthermore, the fatigue behavior of a strand as defined hereinabove is not as good as that of the wire of which it is made because the differential elongation between the peripheral wires and the central wire gives rise to differential movements with radial pressure and therefore to friction between the wires which is not really favorable in terms or fatigue.

An additional drawback lies in the work hardening that results from the twisting, which creates a stiff steel with residual internal tensions making it less ductile and therefore susceptible to creep or to relaxation, according to the type of loading. In order to attempt to reduce this drawback, an operation that consists in exerting tension under a high temperature close to 400° C. is performed. This operation leads to additional cost and may be tricky because it demands a great deal of precision on the temperature when the wires are galvanized wires. This is because the melting point of zinc is not to be exceeded while at the same time not reducing the temperature too far as this would render the operation ineffective.

SUMMARY OF THE INVENTION

Furthermore, in order to obtain good protection against corrosion, it is common practice for a plastic film to be extruded over the strand. Prior to this extrusion operation, a spacer device allows the spaces between the wires around the central wire to be filled with a flexible product such as grease or wax. This operation, because of the need to untwist the wires and then twist them again, leads to further work hardening by deformation of the peripheral wires, which reduces the ductility of the strand.

The object of the invention is to overcome the aforementioned drawbacks by providing a reinforcement the mechanical performance of which is equivalent and even equal to that of each of the wires of which it is made.

To this end, according to the invention, a reinforcement of the kind in question is essentially characterized in that the wires are roughly mutually parallel to form a bundle and in that it comprises a plastic sheath which envelops the bundle, providing it with cohesion.

By virtue of this arrangement, the cohesion of the reinforcement obtained is preserved while the mechanical properties of the reinforcement are equivalent or equal to those of a constituent wire.

In preferred embodiments of the reinforcement according to the invention, recourse is further had to one and/or another of the following provisions:

- the solid wires are metal wires and the sheath is made of flexible plastic extruded onto the bundle;
- the solid wires are wires made of composite and the sheath is made of flexible plastic extruded onto the bundle;
- the bundle of wires comprises a central wire and peripheral wires, the peripheral wires being tangential to the central wire and separated from one another, delimiting grooves;
- the sheath has a cylindrical exterior shape and has a lobed interior wall with recesses and projections, the peripheral wires being housed in the recesses and the projections extending into the grooves;
- the sheath has an exterior wall which in cross section is of circular shape;
- the sheath has an exterior wall which in cross section is of a lobed shape;
- the sheath has an exterior wall which in cross section is of roughly polygonal shape;
- the sheath and the wires delimit gaps which are filled with a lubricant chosen from wax and grease; and
- the sheath and the wires delimit gaps which are filled with a bonding device.

Furthermore, another subject of the invention is a cable for a building work structure comprising at least two reinforcements as defined hereinabove.

A further subject of the invention is a method for packaging a reinforcement as defined hereinabove by parallel winding onto a drum, making one full twist over one turn.

Finally, a subject of the invention is a method for implementing, in a building work, a reinforcement as defined hereinabove, consisting in that in at least one portion of the reinforcement, the solid wires are bared and the bared wires are anchored to at least a constituent part of the building work so as to cause the reinforcement to work in tension.

Advantageously, the collection of solid wires of the reinforcement are wedged collectively into an anchoring jaw assembly.

Other features and advantages of the invention will become apparent in the course of the detailed description which follows of a number of its embodiments which are given by way of nonlimiting examples, with reference to the appended drawings, in which:

DESCRIPTION OF PREFERRED EMBODIMENT

Figure 1:
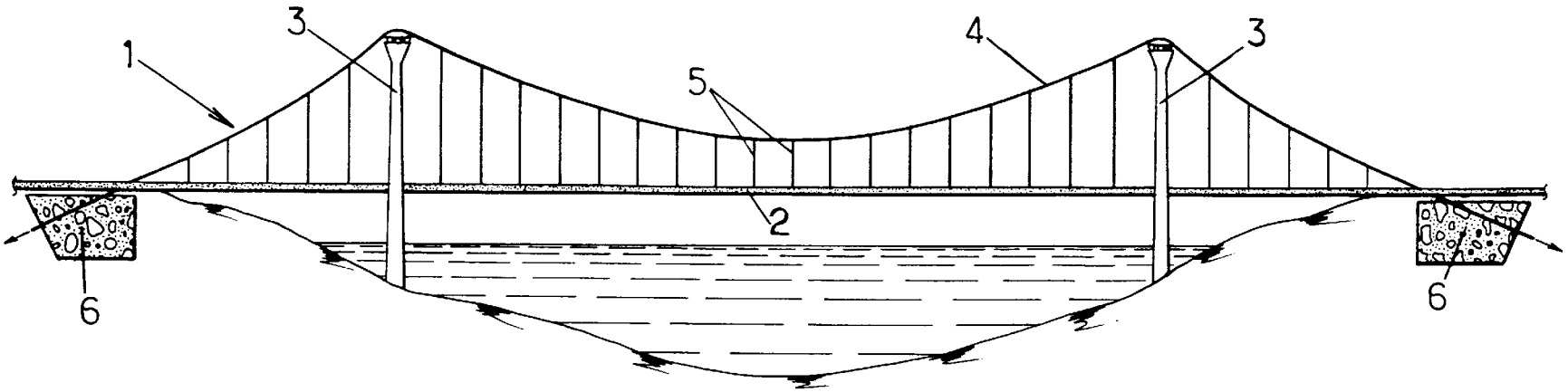
FIG. 1 is an overall schematic view of a suspension bridge comprising reinforcements according to the present invention.

The building works structure 1 depicted in FIG. 1 is, for example, a suspension bridge. This bridge comprises, in the conventional way, a deck 2, two towers 3, two parallel suspension cables 4, just one being visible in the figure, and a number of hangers 5 which are attached to the cables 4 and which carry the deck 2.

The suspension cables 4 are tensioned between two anchors in the ground 6 located at the two ends of the bridge, and are supported by the two towers 3.

Figure 2:
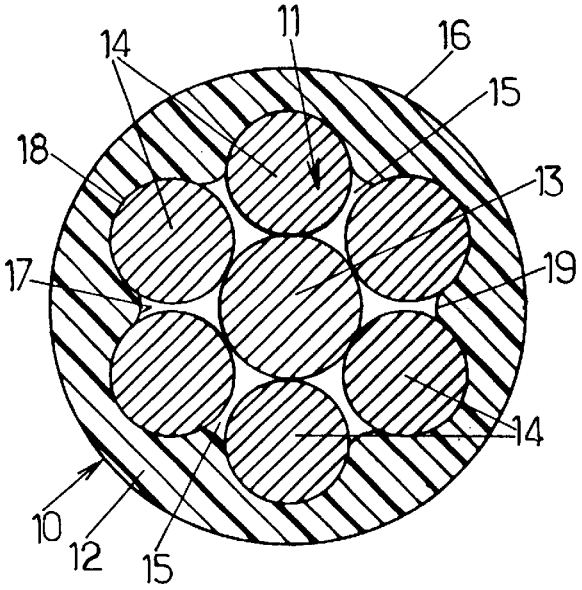
FIGS. 2 to 6 are respective views in cross section of a reinforcement according to a first, a second, a third, a fourth and a fifth embodiment.

Each suspension cable 3 consists of one or more reinforcements 10 according to a first embodiment of the invention, like the one depicted in FIG. 2.

Each reinforcement 10 consists of a collection of solid wires 11 which form a bundle enveloped in a sheath 12. The reinforcement 10 thus formed is also known as a strand, and may be combined with other strands to form the cable 4. It is thus understood that the term "reinforcement" denotes a flexible assembly which can be wound so that it can be stored and transported, and is then unwound to be installed in a building work.

Within a strand, the wires 11 are generally seven in number and comprise a central wire 13 around which six peripheral wires 14 are arranged. The wires 13 and 14 run parallel to each other and are, for example, made of steel.

The wires 13 and 14 are in mutual contact along their generatrix. Only the central wire 13 is in contact with all the other peripheral wires 14. The peripheral wires 14 are separated one from the next and delimit grooves 15 which face toward the outside of the bundle of wires 13, 14.

The collection of wires 13 and 14 is extruded with the sheath 12. This sheath forms an outer envelope made of flexible plastic which may be HDPE or amorphous polypropylene. The sheath 12 provides the collection of wires 13 and 14 with cohesion.

The sheath 12 is of hollow cylindrical shape and has an exterior wall 16 and an interior wall 17. The thickness of the sheath is small by comparison with its length.

In the first embodiment (FIG. 2), the exterior wall 16 is, in cross section, of circular shape whereas the interior wall 17 is, in cross section, lobed. This wall thus has recesses 18 and projections 19 which follow on from one another alternately along the circumference of the interior wall.

The peripheral cables 14 are housed in the recesses 18 and the projections 19 extend between the cables 14 into the grooves 15. Thus, the peripheral cables are held firmly by the sheath.

Figure 3:
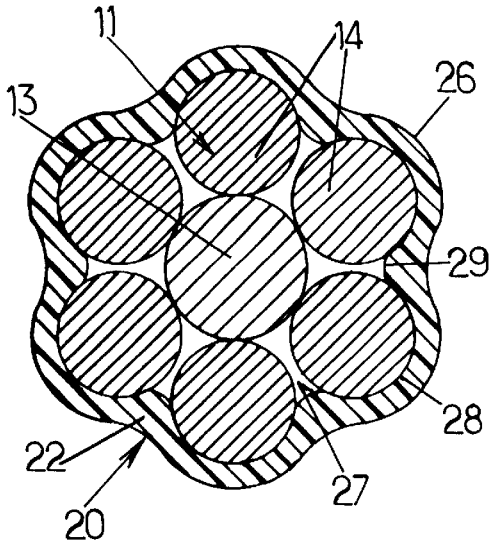

In a second embodiment, like the one depicted in FIG. 3, the reinforcement 20 can be distinguished from the reinforcement 10 only by the shape of the exterior wall of the sheath or sheath 22. This sheath has an exterior wall 26 and an interior wall 27 which, in cross section, are both of lobed shape.

The interior wall 27 is similar to the interior wall 17 of the sheath 12 of the first embodiment and has recesses 28 and projections 29. The exterior wall 26 has recesses and projections which correspond respectively with the projections and the recesses of the interior wall 27.

Figure 4:
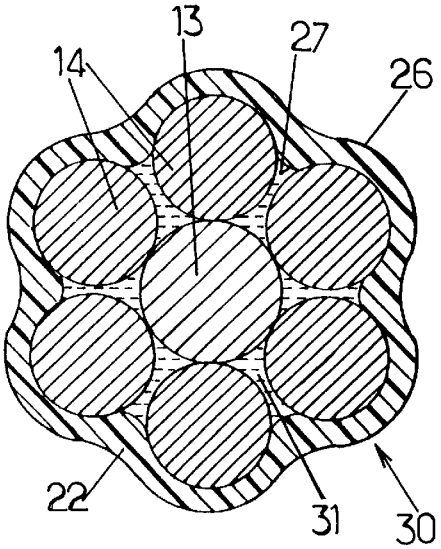

The reinforcement 30 of the third embodiment depicted in FIG. 4 differs from the reinforcement 20 previously described only in that the wires 13 and 14 are embedded in an elastomer matrix 31 such as polybutadiene or the like. This matrix occupies the gaps between the wires 13, 14. The elastomer 31 adheres to the wires, by surface adhesion, preferably, by chemical bonding with the sheath 22 in order to increase this adhesion. As an alternative, the matrix may be a lubricant such as wax or grease so as to reduce the friction between the wires and the sheath.

Figure 5:
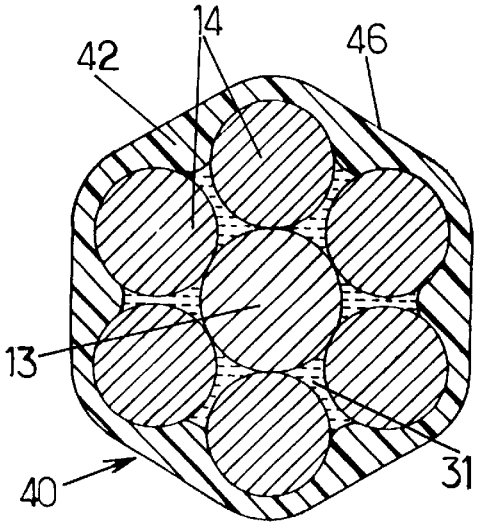
Figure 6:
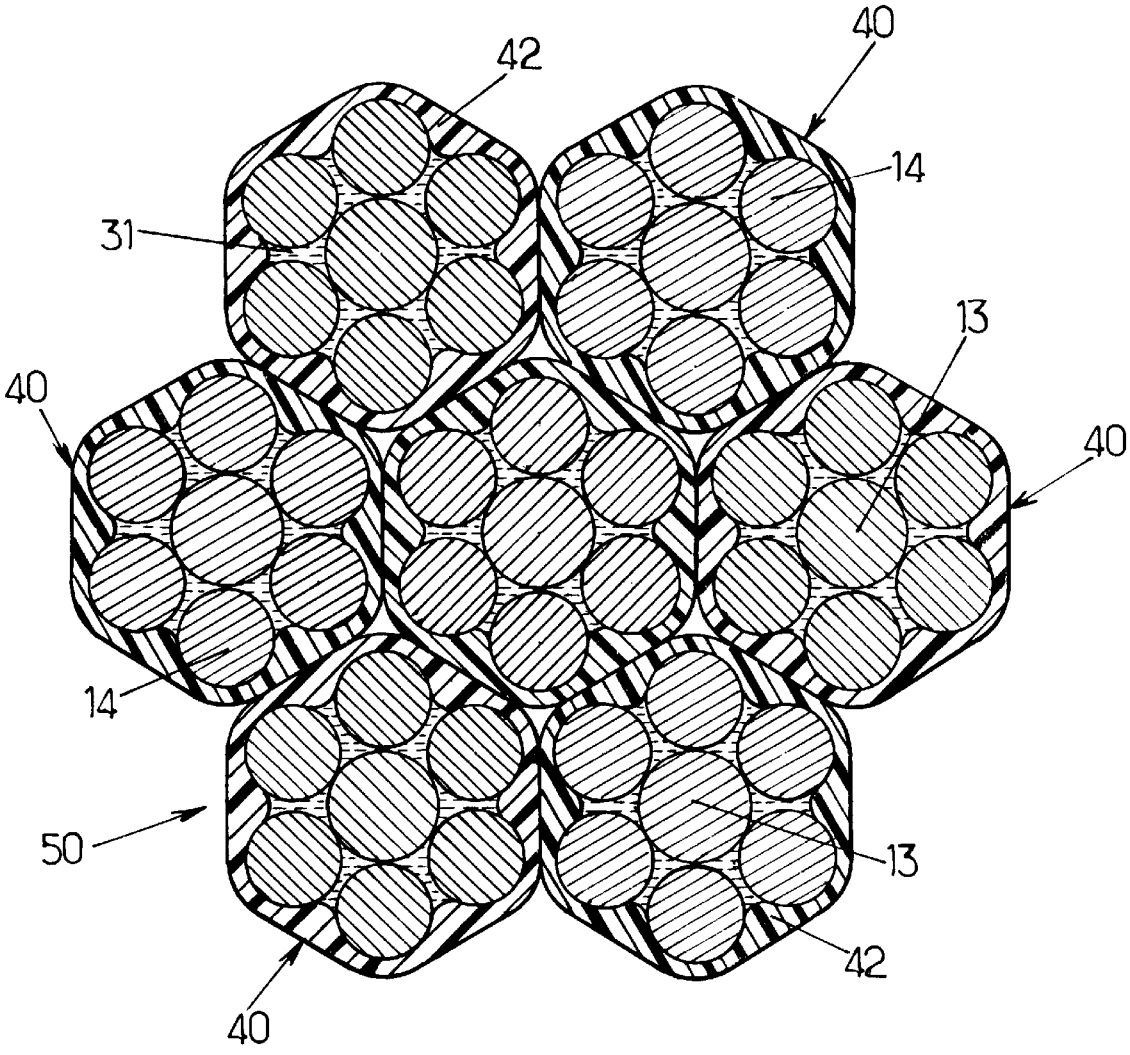

In the fourth embodiment depicted in FIG. 5, the reinforcement 40 differs from the reinforcement 30 described with reference to FIG. 4 in the exterior shape of the sheath 42. The exterior wall 46 of this sheath is no longer of lobed shape in cross section, but of polygonal shape. This shape makes the reinforcements or strands easier to juxtapose in order to form a cable 50 like the one depicted in FIG. 6.

The spaces between the strands 40 can be occupied by a matrix similar to the one described hereinabove.

As an alternative, it is possible to juxtapose reinforcements 40, the wires of which have different diameters from one reinforcement to another.

The strand thus obtained according to one of the embodiments has a mechanical strength, an elastic modulus, fatigue performance and ductility whose values are equivalent and even equal to those of each wire of which it is made.

In order to be packaged and transported to the site of the building work, the strand is wound onto a drum, making one full twist over one turn. The pitch is of the order of one to three meters which means that residual stresses in the elastic region are stored in each constituent wire.

Furthermore, the reinforcement obtained according to one of the embodiments is used within the building work 1 to have the function of one of the cables 4 or hangers 5. For this purpose, a portion of the reinforcement, for example the end, is bared by removing the sheath. The wires thus bared are fixed by means of jaw assemblies, for example into anchors in the ground 6, and the remainder of the reinforcement runs toward the posts 3 so as to cause the reinforcement to work in tension.

The collection of wires 13, 14 is, for example, collectively wedged in the anchoring jaw assembly.

What is claimed is:

1. Reinforcement for a building work structure comprising:

a collection of solid wires which are mutually parallel to form a bundle comprising a central wire and peripheral wires, the peripheral wires being tangential to the central wire and separated from one another, delimiting grooves, and a flexible plastic sheath which is extruded onto the bundle, wherein said sheath has a cylindrical exterior shape and has a lobed interior wall with recesses and projections, the peripheral wires being housed in the recesses and the projections extending into the grooves.

2. Reinforcement according to claim 1, wherein the solid wires are metal wires.

3. Reinforcement according to claim 1, wherein the solid wires are wires made of a composite.

4. Reinforcement according to claim 1, wherein the sheath has an exterior wall which in cross section is of circular shape.

5. Reinforcement according to claim 1, wherein the sheath has an exterior wall which in cross section is of a lobed shape.

6. Reinforcement according to claim 1, wherein the sheath has an exterior wall which in cross section is of polygonal shape.

7. Reinforcement according to claim 1, wherein the sheath and the wires delimit gaps which are filled with a lubricant chosen from wax and grease.

8. Reinforcement according to claim 1, wherein the sheath and the wires delimit gaps which are filled with a bonding device.

9. Cable for building work structure comprising:

at least two reinforcements, each reinforcement includes:

a collection of solid wires which are mutually parallel to form a bundle comprising a central wire and peripheral wires, the peripheral wires being tangential to the central wire and seperated from one another, delimiting grooves, and a flexible plastic sheath which is extended onto the bundle, wherein said sheath has a cylindrical exterior shape and has a lobed interior wall with recesses and projections, the peripheral wires being housed in the recesses and the projections extending into the grooves.

* * * * *